United States Patent [19]

Mitani

[11] Patent Number: 4,762,761

[45] Date of Patent: Aug. 9, 1988

[54] ELECTROPHOTOGRAPHIC PHOTOSENSITIVE MEMBER AND THE METHOD OF MANUFACTURING THE SAME COMPRISES MICRO-CRYSTALLINE SILICON

[75] Inventor: Wataru Mitani, Yokohama, Japan

[73] Assignee: Kabushiki Kaisha Toshiba, Kawasaki, Japan

[21] Appl. No.: 8,356

[22] Filed: Jan. 29, 1987

[30] Foreign Application Priority Data

Mar. 12, 1986 [JP] Japan ..... 61-54099
Mar. 12, 1986 [JP] Japan ..... 61-54100

[51] Int. Cl.[4] ..... G03G 5/14

[52] U.S. Cl. ..... 430/65; 430/66; 430/67

[58] Field of Search ..... 430/65, 66, 67

[56] References Cited

U.S. PATENT DOCUMENTS 4,600,672 7/1986 Fujimura ..... 430/64
4,624,905 11/1986 Haku et al. ..... 430/65
4,678,731 7/1987 Yoshizawa ..... 430/65

*Primary Examiner*—J. David Welsh
*Attorney, Agent, or Firm*—Foley & Lardner, Schwartz, Jeffery, Schwaab, Mack, Blumenthal & Evans

[57] ABSTRACT

Since a barrier layer of an electrophotographic photosensitive member interposed between a photoconductive layer and conductive substrate is formed of a first BN layer of high resistivity laminated with a second μc-Si layer having a rectifying function, the charging capacity is elevated and the residual potential is reduced. A photoconductive layer prepared from a-Si has a high sensitivity to light rays having a broad range of wavelengths. A surface layer prepared from μc-Si containing nitrogen N, carbon C or oxygen O has a high charge-retaining capability.

12 Claims, 1 Drawing Sheet

ELECTROPHOTOGRAPHIC PHOTOSENSITIVE MEMBER AND THE METHOD OF MANUFACTURING THE SAME COMPRISES MICRO-CRYSTALLINE SILICON

BACKGROUND OF THE INVENTION

This invention relates to an electrophotographic photosensitive member for electrophotography.

Until now, an electrophotographic photosensitive member has been prepared from inorganic materials such as CdS, ZnO, Se, Se-Te or amorphous silicon or organic materials such as poly-N-vinylcarbazole (PVCZ) or trinitrofluoren (TNF). However, these conventional photoconductive materials have presented various difficulties in manufacturing the subject product. Consequently, these materials have been selectively used in accordance with the intended object with some lack of performance of the desired properties of an electrophotographic photosensitve member.

For example, Se and CdS are harmful to the human body, demanding particular care in manufacturing, from the point of ensuring safety. Therefore, these materials are accompanied with the drawbacks that the manufacturing phase involves a complicated process, resulting in a high manufacturing cost and high recovery costs due to the required recovery of Se. Moreover, the Se and Se-Te series have as low a crystallization temperature as 65° C. Therefore, when copying is repeated, difficulties arise with respect to the photoconductive property, for example, in residual potential. Consequently the Se and Se-Te series have a short effective life and are reduced in practicability.

Moreover, ZnO easily undergoes oxygen reduction, and is noticeably affected by exposure to the atmosphere, and has a low reliability in application.

Further, organic photoconductive materials such as PVC and TNF are suspected to be carcinogens. These materials present difficulties from the point of view of safety to the human body, and, what is worse, are handicapped by low thermal stability, abrasion resistance and a short effective life, as is characteristic of organic materials On the other hand, amorphous silicon (hereinafter abbreviated as "a-Si") has recently attracted wide attention as a photosensitive material, and has been successfully applied for use in a solar cell, thin film transistor and image sensor. Description may now be made of the application of a-Si as the photoconductive material of an electrophotographic photosensitive member (Japanese patent disclosure No. Sho 59-12448). Offering the advantages that it is harmless and need not be recovered, a-Si has a higher panchromatic sensitivity in the region of visible rays than other materials, and has a great resistance to abrasion and impact due to its significant surface hardness.

Research has been done on a-Si as a photosensitive member for electrophotography, based on the Carlson process. In this case, a photosensitive material with high dark resistance and photosensitivity is required. Since, however, difficulties are presented in causing a single layer photosensitive element to satisfy both requirements, the conventional practice is to provide a barrier layer between the photoconductive layer and conductive support and deposit a surface charge-retaining layer on the photoconductive layer and try to meet the above-mentioned requirements with the resultant laminate structure.

Description may now be made of a-Si. Generally, this material is manufactured by the glow discharge decomposition process involving the introduction of silane series gas. In this case, hydrogen is incorporated into the a-Si layer. Electrical and optical properties noticeably vary with the content of hydrogen. Namely, the greater the quantity of hydrogen carried into the a-Si layer, the more enlarged the optical band gap, and consequently the resistance of the a-Si layer is raised. Since the a-Si layer is more reduced in sensitivity to the light rays having long wavelengths, it is difficult to practically utilize a laser beam printer equipped with, for example, a semiconductor laser device. In case the a-Si layer contains much hydrogen, it sometimes happens that the greater part of the layer is occupied, for example, by a structure consisting of $(SiH_2)_n$ bonded with $SiH_2$. In such case, voids are noticeably generated, and silicon dangling bonds are increasingly produced. Such an event causes the photoconductive property of the a-Si layer to be so reduced as to fail to serve an electrophotographic photosensitive member. If, conversely, smaller quantities are taken into the a-Si layer, the optical band gap is reduced and decreases in resistance, but increases in the sensitivity to light rays having long wavelengths. The conventional a-Si layer, manufactured by the customary film-forming process, has the drawbacks that if it decreases in hydrogen content, it tends to be coupled with silicon dangling bonds, resulting in a decrease in the content of hydrogen, which is desired to minimize said coupling. Therefore, the drawbacks arise that generated carriers drop in transmission speed and have a reduced life, leading to the deterioration of the photoconductivity property of the a-Si layer, thereby rendering said a-Si layer unusuable as an electrophotographic photosensitive member.

In this connection, description may now be made of the process of elevating the sensitivity of said a-Si layer to light rays having long wavelengths. This process comprises the steps of mixing a silane-series gas with germane $GeH_4$, applying glow discharge decomposition, and producing a layer having a narrow optical band gap. Generally, however, silane-series gas and $GeH_4$ have different optimum substrate temperatures, resulting in the occurrence of structural defects in the resultant layer and the failure to provide a satisfactory photoconductive property. The spent gas of $GeH_4$, if oxidized, will be converted into a noxious gas. Therefore, the treatment of the exhausted $GeH_4$ gas involves complicated steps. Consequently, the above-mentioned process involving the mixture of silane series gas and germane gas ($GeH_4$) lacks practicability.

SUMMARY OF THE INVENTION

The present invention has been accomplished in view of the above-mentioned circumstances and is intended to provide an electrophotographic photosensitive member which has a high charge-retaining capacity, low residual potential, high photosensitivity to light rays having broad wavelengths from visible rays to near-infrared rays, and a method for manufacturing the same.

To attain the above-mentioned object, the present invention provides an electrophotographic photosensitive member comprising:

a conductive substrate;

a photoconductive layer comprising amorphous silicon;

a first barrier layer comprising boron nitride and provided between the substrate and the photoconductive layer;

a second barrier layer comprising p or n type microcrystalline silicon and provided between the first barrier layer and the photoconductive layer; an a surface layer provided on the photoconductive layer and formed of microcrystalline silicon containing at least one element selected from the group consisting of nitrogen, carbon, and oxygen.

The present invention further provides a method of manufacturing an electrophotographic photosensitive member which comprises the steps of:

forming a boron nitride layer on a conductive substrate by high frequency glow discharge, thereby providing a first barrier layer;

forming a layer of p or n type microcrystalline silicon on said first barrier layer by high frequency glow discharge, thereby providing a second barrier layer;

preparing an amorphous silicon layer on said second barrier layer by high frequency glow discharge, thereby providing a photoconductive layer; and forming a microcrystalline silicon layer containing at least one element selected from the group consisting of nitrogen, carbon and oxygen on said photoconductive layer by means of high frequency glow discharge, thereby providing a surface layer.

The present invention offers the advantages that since the first barrier layer is prepared from boron nitride (BN), the subject product has a high resistivity, and satisfactory blocking capability, and said first BN barrier layer has a high adhesivity to the substrate. The second barrier layer is formed of microcrystalline silicon (hereinafter referred to as "μc-Si") of p or n type according to the chargeable polarity of the photosensitive member. Since the barrier layer according to the present invention consists of a laminated assembly of the first BN layer of high resistivity and the second layer of μc-Si having a rectifying effect, the barrier layer has a high charge-retaining capability and is reduced in residual potential. The photoconductive layer prepared from a-Si has a high sensitivity to light rays having a broad range of wavelengths. The surface layer prepared from μc-Si containing at least one element selected from the group consisting of nitrogen N, carbon C and oxygen O has a high charge-retaining capability. The respective layers constituting the subject electrophotographic photosensitive member are formed by glow discharge, rendering said member quite safe to the human body. Since gasprocessing equipment is not required, the subject method is extremely well-adapted to industrial manufacture.

μc-Si is possessed of the following physical characteristics, and can be clearly distinguished from a-Si and polycrystalline silicon. In X-ray diffraction analysis, only a halo appears in a-Si, which is an amorphous mass, and a diffraction pattern can not be observed. Conversely μc-Si indicates a crystalline diffraction pattern, wherein $2\theta$ lies near 28° to 28.5°. Polycrystalline silicon has a darkness resistance of $10^8\Omega\cdot$cm, whereas μc-Si has a darkness resistance of over $10^{11}\Omega\cdot$cm. Said μc-Si is formed by an aggregation of extremely fine crystals having a larger particle size than a 2-digit number of Å units.

DETAILED DESCRIPTION OF THE PREFERRED EMBODIMENTS

Figure 1:
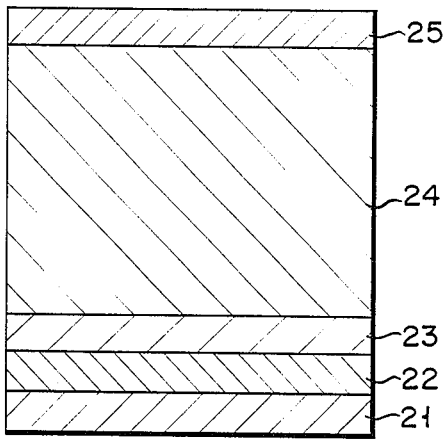
FIG. 1 is a sectional view of an electrophotographic photosensitive member embodying the present invention.

FIG. 1 is a fractional sectional view of an electrophotographic photosensitive member embodying the present invention. First barrier layer 22 prepared from BN is deposited on conductive substrate 21 formed of, for example, an aluminum substrate. Generally, said BN mass is of the amorphous type. Second barrier layer 23, prepared from μc-Si, is mounted on said first barrier layer 22, prepared from said amorphous boron nitride (hereinafter abbreviated as a-BN). Photoconductive layer 24, prepared from a-Si containing hydrogen of 1 to 20 atomic %, is set on said second barrier layer 23. Surface layer 25 is composed of μc-Si containing at least one element selected from the group consisting of C, O and N.

First barrier layer 22 causes streams of carriers (electrons or holes) passing from the conductive support to the photoconductive layer to be restricted, thereby elevating a charge-retaining capability on the surface of the subject electrophotographic photosensitive member and increasing the charging capacity of said member. In the embodiment of the present invention, first barrier layer 22 is prepared from insulative a-BN. This a-BN mass approaches a intrinsic semiconductor (i type) and has a high resistance. a-BN has a high adhesivity to the conductive substrate.

Second barrier layer 23 is prepared from μc-Si, and contains a p or n type impurity. This second barrier layer 23 has a rectifying function, and enables an electric charge to be quickly transmitted from the photoconductive-layer to the conductive support, and conversely restricts the transmission of an electric charge from the conductive support to the photoconductive layer. Consequently, a high charge-retaining capability is ensured on the surface of said photoconductive substrate. In this connection, description may now be made of the Carlson system. When, in this system, the surface of a photosensitive member is positively charged, the second barrier layer is caused to be of the p type in order to prevent electrons from being introduced from the conductive substrate to the photoconductive layer. When the photosensitive member is negatively charged, holes are prevented from being taken from the substrate side to the photoconductive layer. To this end, second barrier layer is converted into the n type.

To cause the μc-Si layer to have the p type, it is preferred to dope elements belonging to Group III of the periodic table, for example, boron B, aluminum Al, gallium Ga, indium In and thallium Tl. To let the μc-Si layer have the n type, it is preferred to dope elements belonging to Group V of the periodic table, for example, nitrogen N, phosphorus P, arsenic As, antimony Sb and bismuth Bi. The above-mentioned doping of p or n type impurity prevents the electric charge from being transmitted from the substrate side to the photoconductive layer.

It is preferred that μc-Si be doped with at least one element selected from the group consisting of nitrogen N, carbon C and oxygen O, because this doping prevents the electric charge from being transmitted from the support side to the photoconductive layer.

It is also preferred that μc-Si be doped with at least one element selected from the group consisting of nitrogen N, carbon C and oxygen O, because this doping elevates the darkness resistance of μc-Si and ensures its high photoconductive property. The above-mentioned elements crystallize in the particulate region of μc-Si, and act as the terminator of the silicon dangling bond, thereby reducing the density of a state prevailing in the forbidden band, thereby presumably elevating the darkness resistance.

Photoconductive layer 24 is formed of a-Si, and contains hydrogen of 1 to 20 or preferably 1 to 5 atomic %. It is idealistically preferred that the photoconductive layer be free from traps tending to capture carriers. Since, however, the silicon layer is not of the single-crystal type, some crystalline irregularities are unavoidably present, and consequently, dangling bonds appear. If, in this case, hydrogen is introduced, it acts as the dangling bond terminator, thereby accelerating the transmission of carriers.

When irradiated by light rays, a-Si generates carriers. In this case, the limit of the amount of produced light rays on the side of a long wavelength is effected by the concentration of hydrogen. When the hydrogen concentration stands at about 20 atomic %, the limit wavelength on the side of a long wavelength ranges between 650 and 700 nm. Conversely, when the hydrogen concentration falls to 5 atomic %, the limit wavelength extends to 700 to 750 nm, thereby broadening the wavelengths of light rays which can be sensed.

Surface layer 25, deposited on photoconductive layer 24, is prepared from μc-Si containing at least an element selected from the group consisting of C, O and N. The deposition of the surface layer 25 offers the advantages that the photoconductive layer is protected from damage, elevates the charging capacity and enables electric charge to be satisfactorily retained. a-Si, the main constituent of the photoconductive layer, has as large a refraction index as 3 to 4, and easily tends to give rise to the reflection of light rays on the surface of said photoconductive layer. In such case, the amount of light rays absorbed in the photoconductive layer decrease, resulting in noticeable losses of light rays. Therefore, a surface layer is provided to prevent light reflections.

A photoconductive layer involving the above-mentioned μc-Si can be formed on the conductive substrate by the high frequency glow discharge decomposition process, as in the case of a-Si, with silane gas used as a raw material. If, in this case, the conductive substrate is held at a higher temperature and greater high frequency power is applied than when a-Si is formed, μc-Si can be deposited with greater ease. Further, the high temperature of the conductive substrate and great high frequency power enable a raw gas like silane gas to flow at a grater rate, thus accelerating the formation of the photoconductive layer. Further, the dilution of high order silane gas, such as $SiH_4$ and $Si_2H_6$, used as a raw gas with hydrogen, ensures a more efficient formation of μc-Si.

Figure 2:
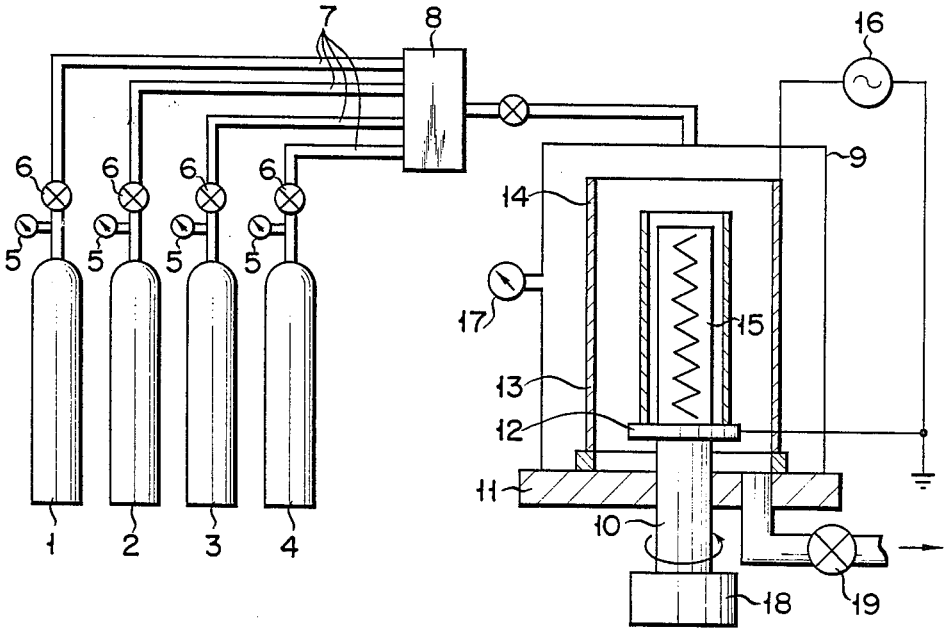
FIG. 2 illustrates an apparatus for manufacturing the same.

Description may now be made with reference to FIG. 2 of an electrophotographic photosensitive member embodying the present invention. Cylinders 1, 2, 3, 4 are respectively filled with any of the raw gases such as $SiH_4$, $B_2H_6$, $H_2$, He, Ar, $CH_4$ and $N_2$. The gases held in said gas cylinders 1, 2, 3, 4 are supplied to mixer 8 through the corresponding flow rate-adjusting valves 6 and pipes 7. The cylinders 1, 2, 3, 4 are respectively fitted with a pressure gage 5. The flow rate and mixing ratio of the raw gases supplied to mixer 8 can be adjusted by reading indications on the pressure gages 5 and valves 6. The gases mixed in mixer 8 are taken into reactor 9. Bottom board 11 of reactor 9 is fitted with horizontally rotatable shaft 10. Disc support 12 is fixed to the upper end of rotatable shaft 10, with the plane of said disc support 12 set perpendicular to said shaft 10. In reactor 9, cylindrical electrode 13 is erected on bottom board 11 with the center of said electrode 13 rendered concentric with said rotatable shaft 10. Draw-shaped main body 14 of a photosensitive member is mounted on said disc support 12 in a concentric relationship with said rotatable shaft 10. Heater 15 is located in said drum-shaped main body 14. High frequency power source 16 is connected between electrode 13 and drum-shaped main body 14 to supply high frequency current to them. Rotary shaft is driven by motor 18. Pressure within reactor 9 is watched by pressure gage 17. Reactor 9 is connected to suitable exhaust means, for example, a vacuum pump through gate valve 19.

When a photosensitive member is manufactured by an apparatus constructed as described above, drum-shaped main body 14 is first set in reactor 9. The interior of reactor 9 is evacuated to a lower pressure level than about 0.1 Torr with gate valve 19 left open. Thereafter, required reaction gases are taken into reactor 9 from cylinders 1, 2, 3, 4 at the predetermined mixing ratio. In this case, raw gases are carried into reactor 9 at such a flow rate as to set the interior pressure of reactor 9 at a level of 0.1 to 1 Torr. Thereafter, motor 18 is driven for the rotation of drum-shaped main body 14. Said main body 14 is heated to the predetermined temperature by heater 15 and a high frequency current is supplied between electrode 13 and drum-shaped main body 14 from high frequency power source 16 to generate glow discharge therebetween. As a result, a layer of a-Si, μc-Si or a-BN is deposited on drum-shaped main body 14. In this case, a layer of a-Si or μc-Si may contain an element such as N, C, or O by applying a raw gas such as $N_2O$, $NH_3$, $NO_2$, $N_2$, $CH_4$, $C_2H_4$ or $O_2$.

Doping of the layer μc-Si or a-Si with hydrogen, for example, by the glow discharge decomposition process may be carried out either by a glow discharge within reactor 9 of a mixture of a raw gas, such as $SiH_4$ or $Si_2H_6$ of the silane series and a carrier gas such as hydrogen or helium. Or said glow discharge decomposition may be made of a gaseous mixture of halogenized silicon, such as $SiF_4$ or $SiCl_4$ and hydrogen or helium. Or said glow discharge decomposition may be made of a gaseous mixture of a gas of the silane series and halogenized silicon. Further, it is possible to form a layer of μc-Si or a-Si by a physical process such as sputtering, in place of the glow discharge decomposition.

As mentioned above, the electrophotographic photosensitive member embodying the present invention offers the advantages that since the subject product can be manufactured within a closed system, safety to the human body is ensured; the subject electrophotographic photosensitive member has a high resistance to heat, humidity and abrasion, and is negligibly deteriorated in property even when repeatedly applied over a long period of time, namely, if has a long effective life; since it is unnecessary to apply a long-wave sensitizer such as $GeH_4$, an exhausted gas-processing device is unnecessary; and the subject photosensitive member can be industrially manufactured with an extremely high yield.

The present invention will become more apparent with reference to the following examples and controls.

EXAMPLE·1

First, a cylindrical conductive support prepared from aluminum was set in a reactor. An evacuating system was operated to reduce the pressure within the reactor to a level lower than $10^{-3}$. The conductive support was held at about 400° C.

Thereafter, $B_2H_6$ gas, diluted to 2% by He gas, was caused to flow through the reactor at the rate of 30 SCCM, and also $N_2$ gas was carried through the reactor at the rate of 800 SCCM. The reactor was evacuated, for example, by a mechanical booster pump and rotary pump to reduce reaction pressure to a level of 0.5 Torr. 1 kw of 13.56 MHz high frequency power was impressed to generate plasma of $B_2H_6$ and $N_2$ between the electrode and drum. Film formation was continued for 6 minutes 30 seconds to provide a first barrier layer prepared from BN. Said first layer had a thickness of 0.6 μm.

After the formation of the first BN barrier layer, the gas supply was stopped. After a lapse of a predetermined period of time, the interior pressure of the reactor reached a level of $10^{-3}$ Torr. Taken into the reactor were 100% $SiH_4$ gas at the rate of 80 SCCM, $H_2$ at the rate of 150 SCCM, and $B_2H_6$ gas, diluted by $H_2$ to 1%, at the rate of 60 SCCM. A glow discharge was generated under the conditions:

| | |
|---|---|
| Reaction pressure | 0.4 Torr |
| High frequency power | 1.2 kw |

Film formation was continued for 40 minutes, thereby depositing a p-type second barrier layer of μc-Si with a thickness of 0.8 μm. As measured by the X-ray diffraction process, the crystallinity of said μc-Si layer was 60% and the size of crystallized particles was 40 Å.

After the formation of the second barrier layer, the gas supply was suspended for a predetermined length of time, thereby maintaining the interior pressure of the reactor at $10^{-3}$ Torr. Then, $SiH_4$ gas was carried through the reactor at the flow rate of 100 SCCM, and $H_2$ at the flow rate of 2800 SCCM. Film formation was continued for 3 hours and 30 minutes under the conditions:

| | |
|---|---|
| Reaction pressure | 1.2 Torr |
| High frequency power | 2.0 kw |

As a result, a-Si:H photoconductive layer was formed with a thickness of 20 μm.

After the gas supply was suspended, the interior pressure of the reactor was maintained at $10^{-3}$. The reactor was supplied with 100% $SiH_4$ gas at the flow rate of 60 SCCM and $N_2$ gas at the flow rate of 500 SCCM. Film formation was continued for 15 minutes under the conditions:

| | |
|---|---|
| Reaction pressure | 0.8 Torr |
| High frequency power | 800 W |

As a result, a μc-Si surface layer containing N was deposited with a thickness of 0.5 μm.

Control 1

In this control, a barrier layer was prepared from p-type a-Si containing B. A photoconductive layer was formed of a-Si containing H. A surface layer was comprised of a-Si containing N. The barrier layer was formed under the conditions:

| | |
|---|---|
| Flow rate of $SiH_4$ | 70 SCCM |
| Ratio between $B_2H_6$ and $SiH_4$ | $4.2 \times 10^{-2}$ |
| High frequency power | 200 W |

The photoconductive layer was formed under the conditions:

| | |
|---|---|
| Flow rate of $SiH_4$ gas | 1000 SCCM |
| Flow rate of $H_2$ gas | 1000 SCCM |
| High frequency power | 320 W |

The surface layer was formed under the conditions:

| | |
|---|---|
| Flow rate of $SiH_4$ | 100 SCCM |
| Flow rate of $N_2$ | 800 SCCM |
| High frequency power | 450 W |

The barrier layer, photoconductive layer and surface layer formed under the above-mentioned conditions had respective widths of 1.0 μm, 25 μm and 0.5 μm.

When impressed with a voltage of +6 kV, an electrophotographic photosensitve member manufactured through the above-mentioned steps indicated the surface potential and photosensitivity as given in Table 1 below.

TABLE 1

| | Surface Potential (V) | Photosensitivity (lux · sec) |
|---|---|---|
| Example 1 | 800 | 0.18 |
| Control 1 | 450 | 0.6 |

Table 1 above clearly shows that the electrophotographic photosensitive member representing Example 1 of the present invention had a far higher charging capacity and photosensitivity than Control 1. These advantages result from the fact that the barrier layer consists of a laminated assembly of first BN layer and second μc-Si layer.

The results of image evaluation tests of both Example 1 and Control 1 are shown in Table 2 below.

TABLE 2

| Number of copies | 20 thousand sheets | 50 thousand sheets | 70 thousand sheets | 100 thousand sheets | 120 thousand sheets | 150 thousand sheets |
|---|---|---|---|---|---|---|
| Example 1 | ◎ | ◎ | ◎ | ○ | ○ | △ |

TABLE 2-continued

| Number of copies | 20 thousand sheets | 50 thousand sheets | 70 thousand sheets | 100 thousand sheets | 120 thousand sheets | 150 thousand sheets |
|---|---|---|---|---|---|---|
| Control 1 | ◎ | ◎ | ○ | Δ | X | X |

Note: ◎ indicates an excellent impression.
○ shows a good impression.
Δ represents a somewhat unsatisfactory impression.
X means a bad impression.

Table 2 above clearly proves that the electrophotographic photosensitive member embodying Example 1 has a long effective life and more prominently sets forth its characteristics, as copy sheet impressions increase in number.

EXAMPLE 2

This example differs from Example 1 only in that the surface layer is prepared from μc-Si containing C. This surface layer was formed under the conditions:

| | |
|---|---|
| Flow rate of $CH_4$ replacing $N_2$ | 300 SCCM |
| Reaction pressure | 0.7 Torr |
| High frequency power | 800 W |
| Time of film formation | 12 minutes |
| Film thickness | 0.6 μm |

Control 2

Control 2 differs from Control 1 only in respect of the surface layer. In Control 2, the surface layer was prepared from a-Si containing C under the following conditions:

| | |
|---|---|
| Flow rate of $CH_4$ replacing $N_2$ used in Control 1 | 450 SCCM |

Note: Control 2 showed a less satisfactory charging capacity and photosensitivity than Example 2.

EXAMPLE 3

Example 3 differs from Example 1 only in that the surface layer was prepared from μc-Si containing O. The surface layer was formed under the following conditions:

| | |
|---|---|
| Flow rate of $O_2$ replacing $N_2$ | 3 SCCM |
| Reaction pressure | 0.4 Torr |
| High frequency power | 300 W |
| Time of film formation | 10 minutes |
| Film thickness | 0.6 μm |

Control 3

Control 3 differs from Control 1 only in respect of the surface layer. The surface layer was prepared from O-containing a-Si by introducing $O_2$ gas through the reactor in place of $N_2$ in Control 1 at the flow rate of 5 SCCM.

Note: Control 3 indicated for less satisfactory charging capacity and photosensitivity than Example 3.

EXAMPLE 4

Example 4 differs from Example 1 only in the hydrogen content of the photoconductive layer. The photoconductive layer was formed under the following conditions:

| | |
|---|---|
| Flow rate of $SiH_4$ | 120 SCCM |
| Flow rate of $H_2$ | 600 SCCM |
| Reaction pressure | 1.2 Torr |
| High frequency power | 2.0 kw |
| Time of film formation | 3 hours 30 minutes |

Under the above-mentioned condition, an a-Si:H layer containing 3.34 atomic % of hydrogen was formed with a thickness of 14 μm. When impressed with a voltage of +6 kV, the subject photosensitive layer indicated a surface potential of 800 V and a photosensitivity of 0.2 lux second.

EXAMPLE 5

Example 5 differs from Example 4 only in that the surface layer was prepared from C-containing μc-Si. The surface layer was formed under the conditions:

| | |
|---|---|
| Flow rate of $CH_4$ replacing $N_2$ applied in Example 4 | 300 SCCM |
| Reaction pressure | 0.7 Torr |
| High frequency power | 800 W |
| Time of film formation | 12 minutes |
| Film thickness | 0.6 μm |

Note: The photosensitive member of Example 5 indicated a surface potential of 810 V, and a photosensitivity of 0.22 lux sec.

EXAMPLE 6

Example 6 differs from Example 4 only in that the surface layer was prepared from O-containing μc-Si. The surface layer was formed under the conditions:

| | |
|---|---|
| Flow rate of $O_2$ applied in place of $N_2$ used in Example 4 | 3 SCCM |
| Reaction pressure | 0.4 Torr |
| High frequency power | 300 W |
| Time of film formation | 10 minutes |
| Film thickness | 0.6 μm |

Note: The photosensitive member of Example 6 indicated a surface potential of 780 V and a photosensitivity of 0.23 lux sec.

What is claimed is:

1. An electrophotographic photosensitive member comprising:
   - a conductive substrate;
   - a photoconductive layer comprising amorphous silicon;
   - a first barrier layer comprising boron nitride and provided between the substrate and the photoconductive layer;
   - a second barrier layer comprising doped microcrystalline silicon and provided between the first barrier layer and the photoconductive layer; and
   - a surface layer provided on the photoconductive layer and formed of microcrystalline silicon containing at least one element selected from the group consisting of nitrogen, carbon and oxygen.

2. The photosensitive member according to claim 1, wherein said photoconductive layer contains 1 to 20 atomic % of hydrogen.

3. The photosensitive member according to claim 2, wherein said photoconductive layer contains 1 to 5 atomic % of hydrogen.

4. The photosensitive member according to claim 1, wherein said first barrier layer is prepared from amorphous boron nitride.

5. A method of manufacturing an electrophotographic photosensitive member comprising the steps of:

forming a boron nitride layer by high frequency glow discharge on a conductive substrate, thereby providing a first barrier layer;

forming a p or n type microcrystalline silicon layer by high frequency glow discharge on said first barrier layer, thereby providing a second barrier layer;

preparing an amorphous silicon layer by high frequency glow discharge on said second barrier layer, thereby providing a photoconductive layer; and forming a microcrystalline silicon layer containing at least one element selected from the group consisting of nitrogen, carbon and oxygen by high frequency glow discharge on said photoconductive layer, thereby providing a surface layer.

6. The method according to claim 5, wherein said first barrier layer is formed by glow discharge plasma in a gaseous atmosphere containing $B_2H_6$ gas and $N_2$ gas.

7. The method according to claim 5, wherein said photoconductive layer is formed by glow discharge in a gaseous atmosphere containing $SiH_4$ gas.

8. The photosensitive member according to claim 1, wherein said second barrier layer is doped with boron.

9. The photosensitive member according to claim 2, wherein said first barrier layer comprises amorphous boron nitride.

10. The photosensitive member according to claim 2, wherein said second barrier layer is doped with boron.

11. The photosensitive member according to claim 1, wherein said photosensitive member is positively charged and said second barrier layer is p type.

12. The photosensitive member according to claim 1, wherein said photosensitive member is negatively charged and said second barrier layer is n type.

* * * * *